US009290927B1

(12) United States Patent
Sheley

(10) Patent No.: US 9,290,927 B1
(45) Date of Patent: Mar. 22, 2016

(54) MOBILE AUTOMATED TELLER MACHINE

(71) Applicant: JPMorgan Chase Bank, N.A., New York, NY (US)

(72) Inventor: William S. Sheley, Dublin, OH (US)

(73) Assignee: JPMorgan Chase Bank, N.A., New York, NY (US)

( * ) Notice: Subject to any disclaimer, the term of this patent is extended or adjusted under 35 U.S.C. 154(b) by 0 days.

(21) Appl. No.: 14/289,809

(22) Filed: May 29, 2014

Related U.S. Application Data

(60) Provisional application No. 61/901,839, filed on Nov. 8, 2013.

(51) Int. Cl.
*G06F 19/00* (2011.01)
*E04B 1/343* (2006.01)

(52) U.S. Cl.
CPC ..... *E04B 1/34357* (2013.01)

(58) Field of Classification Search
USPC ..... 235/379; 902/8
See application file for complete search history.

(56) References Cited

U.S. PATENT DOCUMENTS

| | | | | |
|---|---|---|---|---|
| D249,900 | S | 10/1978 | Lee | |
| D269,822 | S | 7/1983 | Barthel | |
| 4,861,049 | A * | 8/1989 | Losi | 280/47.16 |
| D360,739 | S | 7/1995 | Hall | |
| 5,726,430 | A * | 3/1998 | Ruggirello | 235/379 |
| D437,468 | S | 2/2001 | Fukutake et al. | |
| D456,587 | S | 4/2002 | Kit et al. | |
| 6,422,158 | B1 * | 7/2002 | Fitts et al. | 109/2 |
| D462,776 | S | 9/2002 | Bain et al. | |
| D481,515 | S | 10/2003 | Magee et al. | |
| D494,730 | S | 8/2004 | Magee et al. | |
| D505,765 | S | 5/2005 | Swaine et al. | |
| D592,825 | S | 5/2009 | Kang et al. | |
| D596,373 | S | 7/2009 | Kang et al. | |
| D625,305 | S | 10/2010 | Bleck et al. | |
| D625,485 | S | 10/2010 | Lee et al. | |
| D629,585 | S | 12/2010 | Bleck et al. | |
| D645,223 | S | 9/2011 | Bleck et al. | |
| D672,525 | S | 12/2012 | Lee et al. | |
| D678,652 | S | 3/2013 | Budde et al. | |
| D678,653 | S | 3/2013 | Budde et al. | |
| D678,792 | S * | 3/2013 | Daly et al. | D10/104.1 |
| D690,074 | S | 9/2013 | Budde et al. | |
| D693,983 | S | 11/2013 | Budde et al. | |
| D693,984 | S | 11/2013 | Budde et al. | |
| D696,484 | S | 12/2013 | Lee et al. | |
| D696,485 | S | 12/2013 | Lee et al. | |
| D702,913 | S | 4/2014 | Budde et al. | |
| D702,914 | S | 4/2014 | Budde et al. | |
| 2002/0011393 | A1 * | 1/2002 | Siemens | 194/215 |
| 2002/0074394 | A1 * | 6/2002 | Birnie | 235/379 |

(Continued)

*Primary Examiner* — Daniel Hess
(74) *Attorney, Agent, or Firm* — Hunton & Williams LLP

(57) ABSTRACT

Exemplary embodiments provide a mobile ATM that may be completely self-contained, including having its own power source and communications capability. The mobile ATM may be designed to be transported and installed so that the mobile ATM can be fully functional and ready for customer usage within approximately one hour of arrival at the installation site. The mobile ATM may be constructed of rigid, durable, weatherproof materials. The mobile ATM may include a platform and ramp that are foldable against the ATM for transportation. The mobile ATM may be ADA compliant and may include a charging station supporting the charging of portable electronic devices, in addition to providing financial transaction services.

15 Claims, 10 Drawing Sheets

(56) References Cited

U.S. PATENT DOCUMENTS

| | | | | |
|---|---|---|---|---|
| 2004/0262379 | A1 | 12/2004 | Gomes | |
| 2005/0029340 | A1 | 2/2005 | Ferraro | |
| 2007/0187483 | A1* | 8/2007 | Romary | 235/379 |
| 2008/0296365 | A1 | 12/2008 | Schliebe | |
| 2009/0057398 | A1 | 3/2009 | Douglass et al. | |
| 2010/0187300 | A1 | 7/2010 | Ramachandran et al. | |

* cited by examiner

MOBILE AUTOMATED TELLER MACHINE

CROSS-REFERENCE TO RELATED APPLICATIONS

This application claims the benefit of U.S. Provisional Application No. 61/901,839, filed Nov. 8, 2013. The contents of which are hereby incorporated by reference in their entirety.

BACKGROUND OF THE INVENTION

Automated Teller Machines ("ATMs") enable customers to carry out a variety of banking transactions by interacting with the machine rather than a human teller. When a natural (e.g., a hurricane or tornado) or man-made (e.g., civil unrest or strife) disaster strikes a geographic location, banking services at traditional locations, such as branches and ATM locations, are interrupted including to the point where such banking services are not available at these locations because, after a disastrous event has occurred, there is typically physical damage to the location that leads to power outages (e.g., down power lines), amongst other things, such as restrictions on travel and mobility. The traditional banking services are thus lost because such rely upon existing infrastructure such as power.

Additionally, there is also a need to provide financial services for people at remote locations including various outdoor environments. For example, at a multi-day concert, large groups of transient persons, as well as merchants of goods and services, are present. These persons require access to a variety of banking transactions. However, remote locations in these situations are characteristically not appropriate for conventional ATMs since power sources, suitable surfaces, or appropriate surroundings for operating conventional ATMs are not available.

These and other deficiencies exist.

SUMMARY OF THE INVENTION

An exemplary embodiment includes an apparatus including: a financial services device having an internal volume define by a rigid frame, that includes: a financial services unit, contained in the internal volume, having a display and a computer process, configured to provide financial transaction capability; a stand-alone power source, contained in the internal volume, that is configured to generate power to operate the financial services device; an external platform hindgedly coupled to a bottom section of the rigid frame and configured to retract in a manner to rest against a front section of the financial services device; an external ramp hingedly coupled to the platform and configured to retract in a manner such that the ramp rests against the platform; and a roof hindgedly coupled to a top section of the financial services device.

Another exemplary embodiment includes a method that has steps including: transporting a financial services device to an installation site in a first configuration using a transportation mechanism, wherein the first configuration is a configuration for transportation of the financial services device; removing the financial services device from the transportation mechanism in the first configuration; placing the financial services device onto a surface located at the installation site in the first configuration; deploying the financial services device to second configuration by extending one or more retracted components of the financial services device; and enabling a stand-alone power source of the financial services device to operate the financial services device such that the financial services device is fully operational.

These and other embodiments and advantages of the preferred embodiments will become apparent from the following detailed description, taken in conjunction with the accompanying drawings, illustrating by way of example the principles of the various exemplary embodiments.

DETAILED DESCRIPTION OF THE INVENTION

Figure 1:
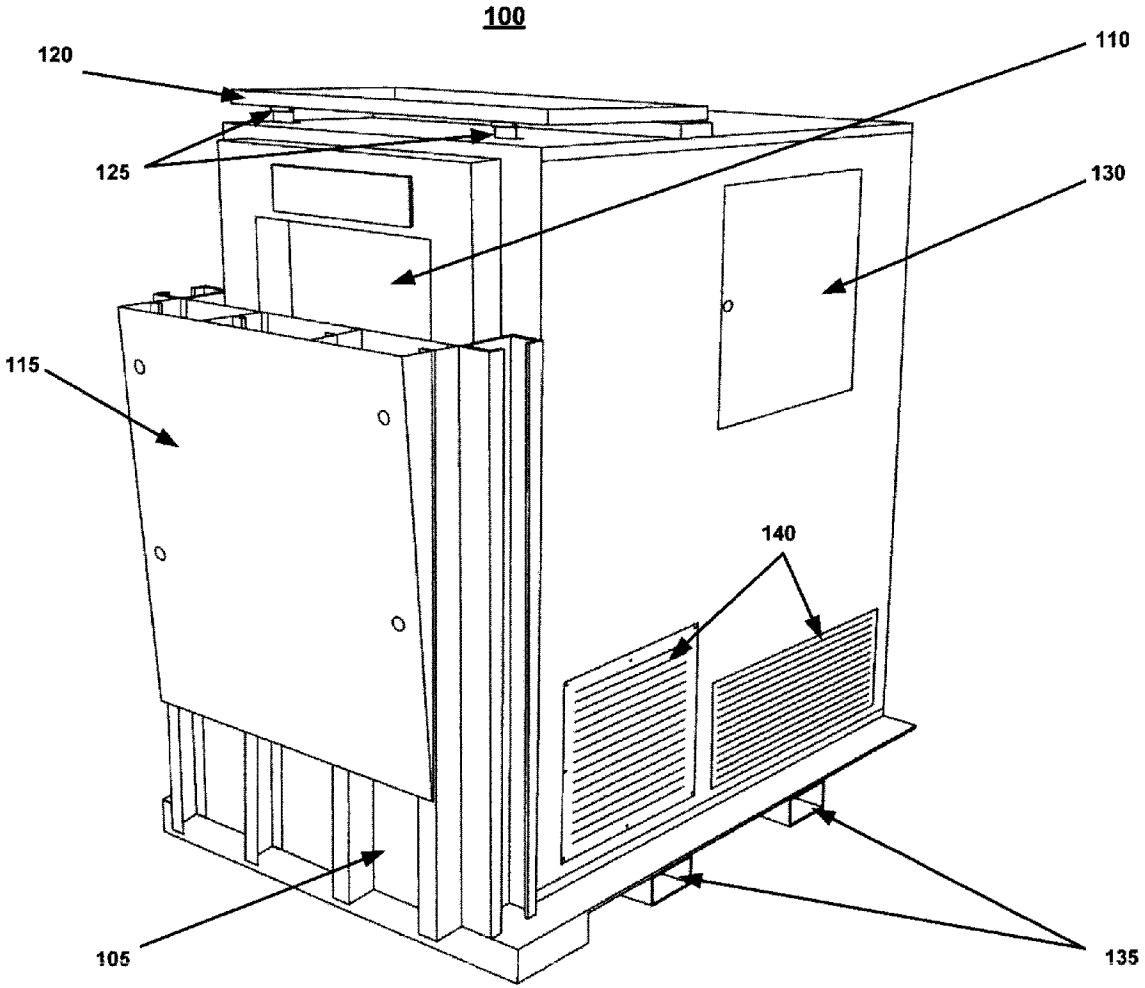
FIG. 1 depicts a front perspective view of a mobile ATM device in accordance with an exemplary embodiment.

It will be readily understood by those persons skilled in the art that the embodiments of the inventions described herein are capable of broad utility and application.

Exemplary methods are provided by way of example herein, as there are a variety of ways to carry out the method disclosed herein. The methods depicted in the Figures may be executed or otherwise performed by one or a combination of various systems, such as described herein. Each block shown in the Figures represents one or more processes, methods, and/or subroutines carried out in the exemplary methods. Each block may have an associated processing machine or the blocks depicted may be carried out through one processor machine. Furthermore, while the steps may be shown in a particular order, it should be appreciated that the steps may be conducted in a different order.

The description of exemplary embodiments describes servers, portable electronic devices, and other computing devices that may include one or more modules, some of which are explicitly depicted in the figures, others are not. As used herein, the term "module" may be understood to refer to executable software, firmware, hardware, and/or various combinations thereof. It is noted that the modules are exemplary. The modules may be combined, integrated, separated, and/or duplicated to support various applications. Also, a function described herein as being performed at a particular module may be performed at one or more other modules and/or by one or more other devices (e.g., servers) instead of or in addition to the function performed at the particular module. Further, the modules may be implemented across multiple devices and/or other components local or remote to one another. Additionally, the modules may be moved from one device and added to another device, and/or may be included in both devices. It is further noted that the software described herein may be tangibly embodied in one or more physical media, such as, but not limited to, a compact disc (CD), a digital versatile disc (DVD), a floppy disk, a hard drive, read-only memory (ROM), random access memory (RAM), as well as other physical media capable of storing software, and/or combinations thereof. Moreover, the figures illustrate various components (e.g., servers, portable electronic devices, client devices, computers, etc.) separately. The functions described as being performed at various components may be performed at other components, and the various components may be combined and/or separated. Other modifications also may be made.

According to exemplary embodiments, the systems and methods may be computer implemented using one or more computers, incorporating computer processors. The computer implementation may include a combination of software and hardware. The computers may communicate over a computer-based network. The computers may have software installed thereon configured to execute the methods of the exemplary embodiments. The software may be in the form of modules designed to cause a computer processor to execute specific tasks. The computers may be configured with hardware to execute specific tasks. As should be appreciated, a variety of computer-based configurations are possible.

The term "Automated Teller Machine" or ATM or financial services device, as used herein, may include, but are not limited to, machines, kiosks, and stations for performing financial services transactions. These ATMs, or financial services devices, include, but are not limited to, automated teller machines, personal teller machines ("PTMs"), financial services kiosks, financial transaction devices, portable electronic devices, money machines, cash machines, bank machines, and bancomats.

The term "financial institution," as used herein, may include an institution that provides financial services to their members or customers. Financial institutions may include, but are not limited to, banks, credit unions, trust companies, mortgage loan companies, insurance companies, investment banks, underwriters, armored car companies, and brokerage firms.

There is a need to deploy self-sustainable ATMs to support financial needs of customers and other persons located in certain areas. According to exemplary embodiments, a mobile ATM is described such that the mobile ATM is capable of being moved and thus is not located a single, fixed location. That is, the device may be capable of being moved or moving from one location to another location. The movement may require the use of external vehicles, such as a tractor trailer and/or forklift.

According to exemplary embodiments, the mobile ATM may have its own power source and/or be able to use external power. The mobile ATM may be able to provide power to users through various connections for the charging and/or powering of portable electronic devices. The mobile ATM may provide access to a full range of financial transactions, including transactions found at typical fixed location ATMs. The mobile ATM may have two-way video and audio capabilities to enable a user to interact with a customer representative of the financial institution on a 24 hour a day basis. The remote customer representative may have the capability to remotely operate and control the mobile ATM.

Figure 2:
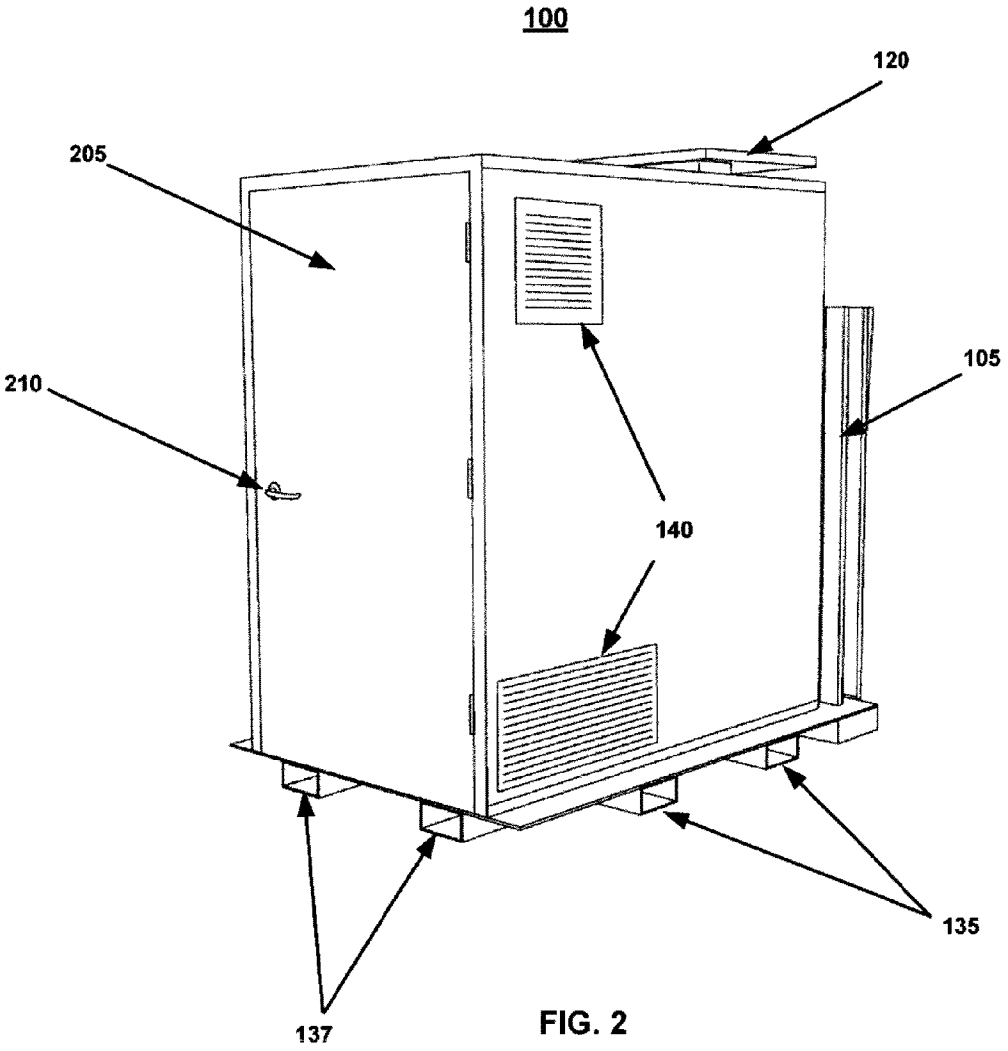
FIG. 2 depicts a rear perspective view of the mobile ATM device in accordance with an exemplary embodiment.

FIGS. 1 and 2 depict perspective views of a mobile ATM according to exemplary embodiments. The mobile ATM 100 may be portable. For example, the mobile ATM may be transported and subsequently used at a variety of locations that may not have available power. For example, these locations may include remote locations supporting large transient groups of persons, such as conventions or multi-day concerts (e.g., Woodstock or Coachella type events). In other embodiments, the locations may include disaster sites. The mobile ATM 100 may provide financial services to the persons located in these various location The mobile ATM 100 may be a completely self-contained unit or pod. The mobile ATM 100 may be designed to be transported and installed so that the mobile ATM can be fully functional and ready for customer usage within approximately one hour of arrival at the installation site. In some embodiments, the mobile ATM 100 may be an existing financial transaction device that has been upgraded to perform the functionality described herein. For example, an existing ATM may be upgraded with the self-containment components according to exemplary embodiments.

The various components of the mobile ATM 100 may be arranged for compact and secure movement of the mobile ATM. In an exemplary embodiment, a platform 105 may be securely closed in the self-contained configuration. The platform 105 may be located at a front portion 110 of the mobile ATM 100 such that it protects the customer interface portion of the ATM 100 during transit. The platform 105 may integrally include a ramp 115 that may be hinged in such a manner the ramp fold up against the platform which in turn folds up against the front portion 110 of the mobile ATM 100 as depicted in FIG. 1, for example. The platform 105 may be secured using various attachment mechanisms, such as hinge pins, nuts, and/or bolts that may be employed to securely retain these components during transport of the mobile ATM. The platform 105 and ramp 115 may be constructed of steel or aluminum or a combination thereof. Diamond tread plating may be used. For example, ⅛" diamond tread plating may be using for the ramp and/or platform. Accordingly, during deployment and installation, the mobile ATM 100 may be deployed such that the platform 105 is extended from the front portion 110 as depicted and described with respect to FIGS. 5 and 6.

A roof 120 may be provided at the upper portion of the ATM 100. The roof 120 may extend out over the front of the mobile ATM 100 to shield a user from the weather (i.e., when the mobile ATM 100 is in use). As depicted in FIG. 1, the roof 120 may be hinged (as shown by hinges 125) such that the roof folds back onto the upper surface of the mobile ATM 100.

The mobile ATM 100 may contain a charging station access 130. The charging station access 130 may be an insulated door that provides access to an interior section of the mobile ATM 100 that may include one or more charging stations. The interior configuration is depicted in FIG. 3. The charging station access 130 may be lockable or otherwise able to be secured.

The mobile ATM may be arranged in a self-contained configuration that includes one or more slots 135 and 137. Each slot 135 and 137 may be a metal tube. For example, the slots 135 and 137 may be a steel tube with dimensions of 4"×8"×3/16". These dimensions are exemplary and non-limiting. As depicted, the slots 135 and 137 may be oriented laterally and axially with respect to the ATM 100 to provide multiple points for engagement as described below.

The slots 135 and 137 may be configured to receive a transportation mechanism that may be any suitable device, machine, or vehicle. For example, the slots 135 of a mobile ATM 100 may be configured to receive the forks of a forklift (the slots 137 may be similarly configured). Subsequently, the forklift can be used to move the mobile ATM 100 from a first location, such as, for example, a storage area, onto a mode of transportation, such as a flatbed truck. A forklift can then be used to move the mobile ATM off of the flatbed truck and to a second location, such as, for example, an installation site. The installation site can be any site of appropriate size and geography to accommodate the mobile ATM 100 placement. For example, the installation site may be required to have a sufficiently hard and flat surface to provide a stable platform for the mobile ATM.

The mobile ATM 100 may have a one or more vents/access 140. The vents/access 140 may serve as ventilation points (intake/exhaust) for the interior of the mobile ATM 100. The vents/access 140 may serve as access points to the interior of the mobile ATM 100.

The mobile ATM 100 may have a rear access 205 as depicted in FIG. 2. The rear access 205 may include a handle 210. The handle 210 may include a locking mechanism. The rear access 205 may allow for access into the interior of the mobile ATM 100.

Figure 3A:
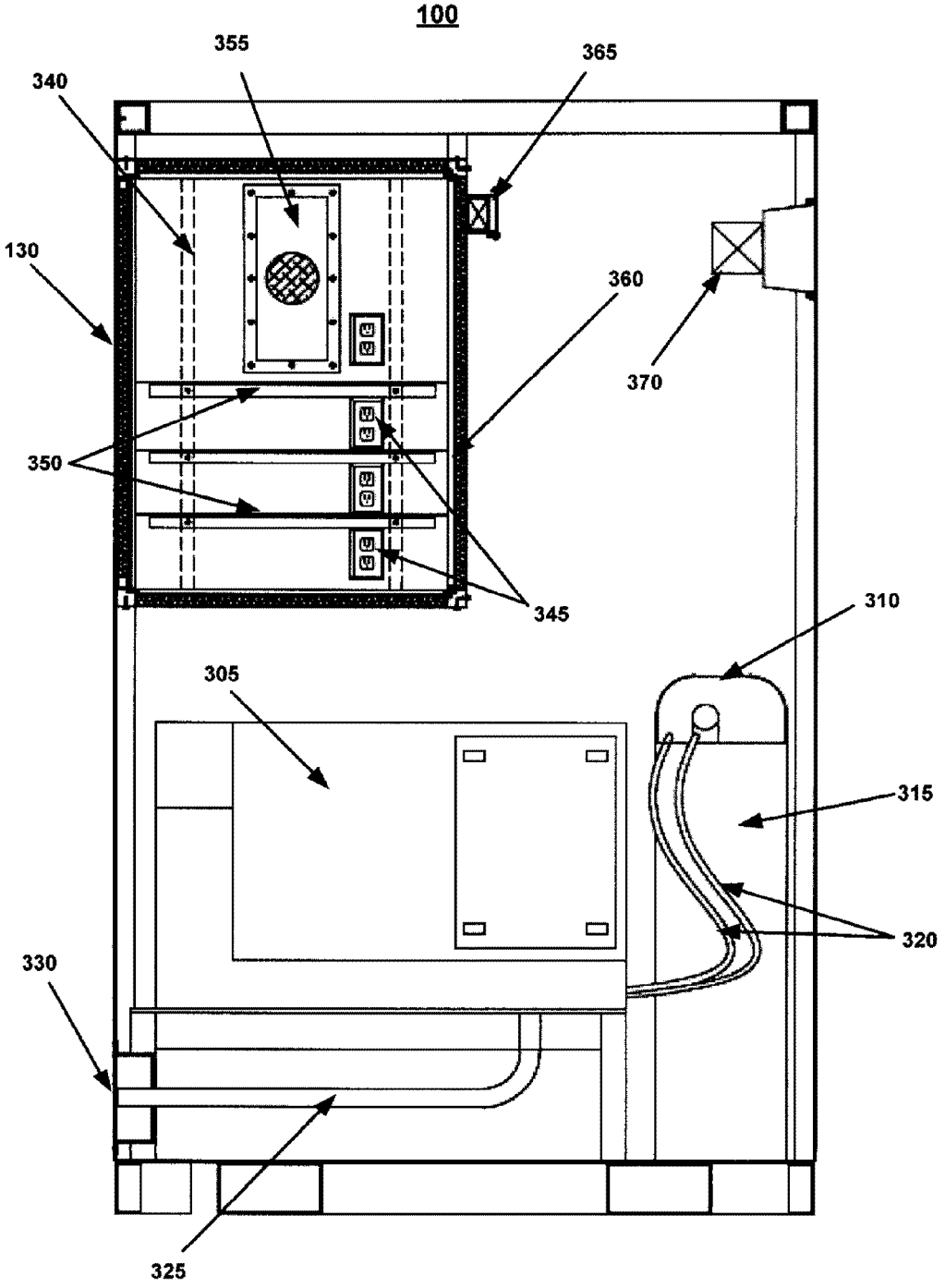
FIG. 3A depicts a rear interior view of the mobile ATM device in accordance with an exemplary embodiment.
Figure 3B:
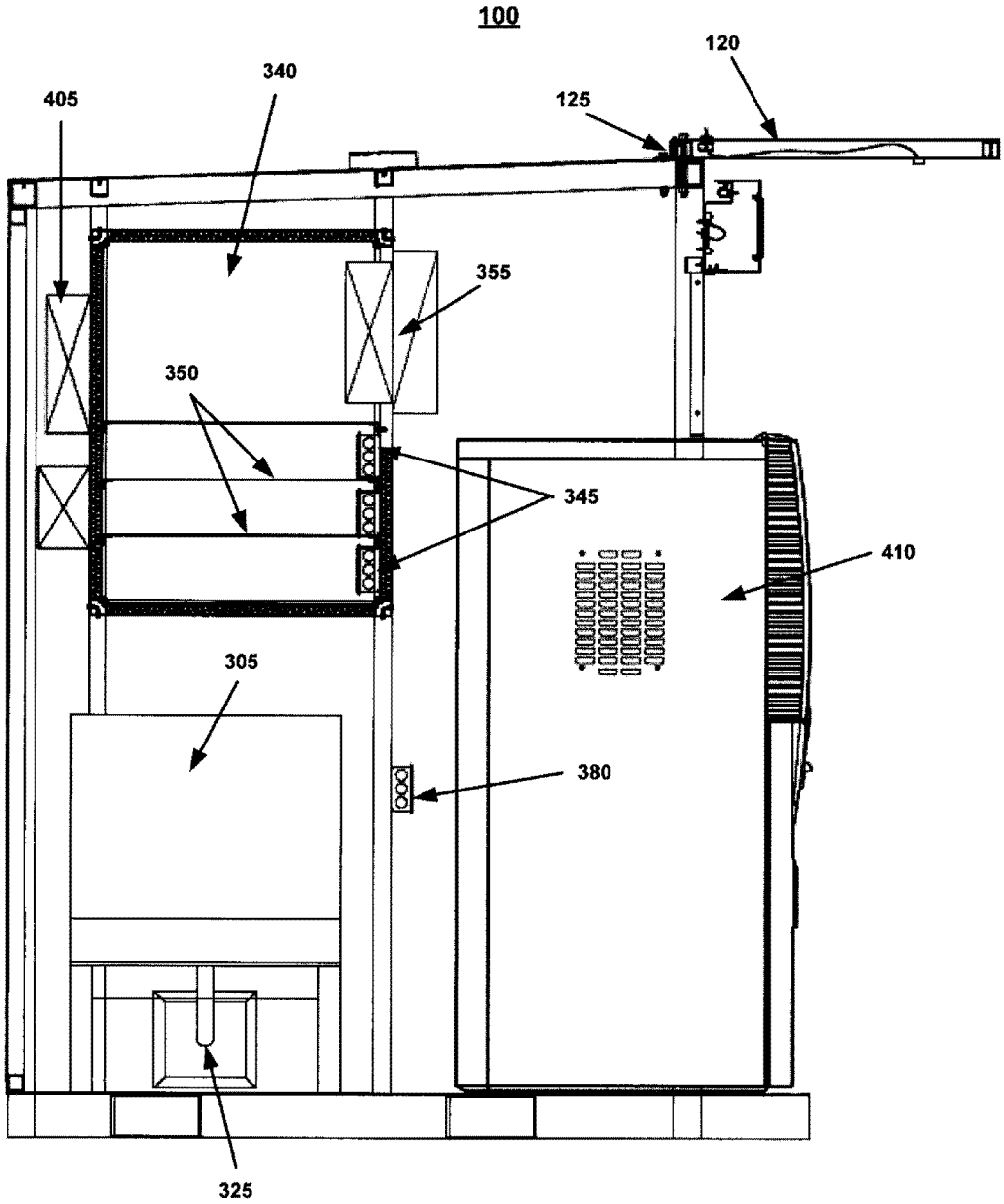
FIG. 3B depicts a side interior view of the mobile ATM device in accordance with an exemplary embodiment.
Figure 4A:
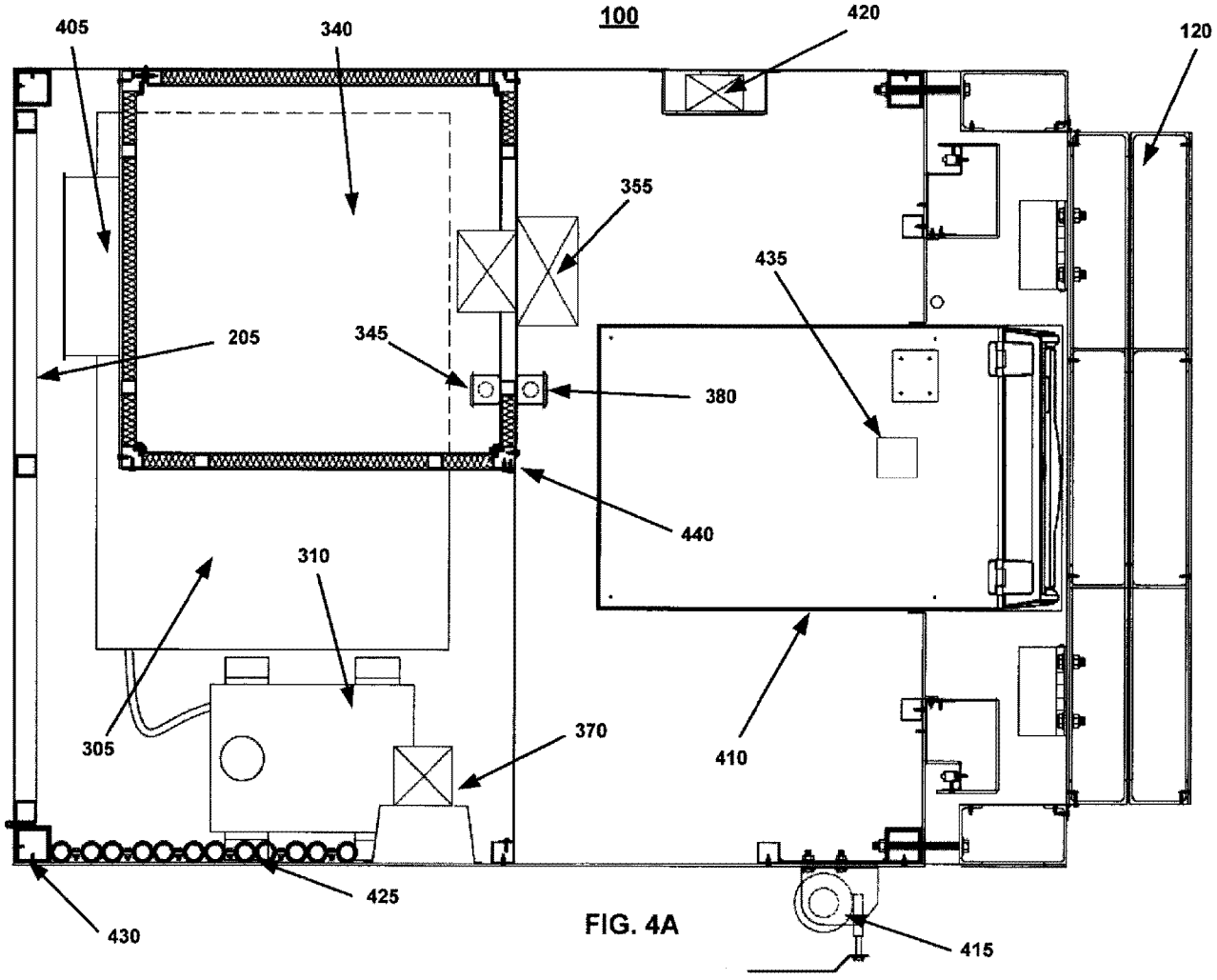
FIG. 4A depicts a top-down interior view of the mobile ATM device in accordance with an exemplary embodiment.
Figure 4B:
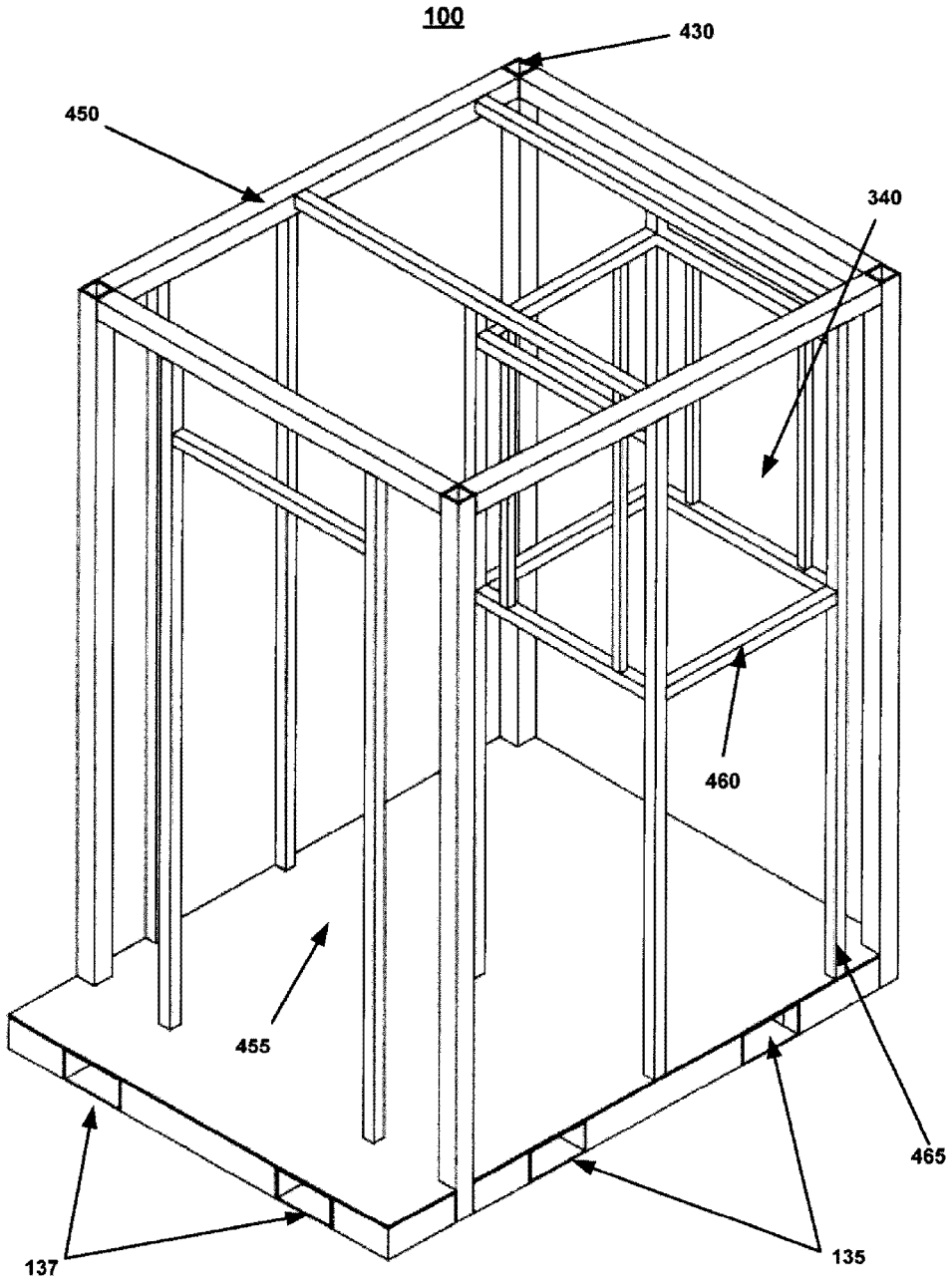
FIG. 4B depicts a perspective view of the frame of the mobile ATM device in accordance with an exemplary embodiment.

FIGS. 3A, 3B, 4A, and 4B depict interior views of the mobile ATM device in accordance with an exemplary embodiment. Specifically, FIG. 3A is an interior view looking towards the front from the rear of the mobile ATM 100 through a point inset from the rear access 210. FIG. 3B is an interior view looking from the right side of the mobile ATM 100. FIG. 4A is a top down interior view of the mobile ATM 100 with the front portion 110 to the right side of the drawing. FIG. 4B is a perspective view of the complete frame of the mobile ATM 100.

Internally, the mobile ATM may have a generator 305. The generator may have a fuel system 310 that includes a fuel tank 315 and fuel lines 320 (that includes an intake and a return line). The generator 305 may have an exhaust pipe 325. The exhaust pipe 325 may exhaust to the atmosphere through a penetration 330 in the side of the mobile ATM 100 as depicted. The exhaust pipe 325 and the penetration 330 may be located behind on the vent/access 140. The generator 305 may be a diesel generator. For example, the generator 305 may be Cummins QD 6000 diesel generator. Other types of diesel generators may be used. In some embodiments, the diesel generator may be replaced with one or more banks of rechargeable batteries. In other embodiments, the generator 305 may include a one or more banks of batteries for backup power.

Accordingly, the mobile ATM 100 may be independently powered using the generator 305. Other stand-alone power sources may be used. Furthermore, in some embodiments, a combination of stand-alone power sources may be used. For example, the mobile ATM may employ a plurality of solar cells in addition to the generator 305. Other combinations are possible.

The charging access 130 may provide access to a compartment 340 as described above. The interior of the charging compartment 340 is depicted in FIG. 3. The charging compartment 340 may include one or more outlets 345. The charging compartment 340 may include one or more shelves 350. Each shelf 350 may be associated with an outlet 345 as depicted. The charging compartment 340 may include a cooling or air-conditioning unit 355. The charging compartment 340 may be insulated with a set of surrounding insulation 360. For example, 1" of insulation may be used. It should be appreciated that this dimension is exemplary and non-limiting. Mounted on the charging compartment 340 may be a power supply 365. The power supply 365 may include different types of power supplies for the various components of the mobile ATM 100, including those components of the charging compartment 340 such as the outlets 345. For example, the power supply 365 may include a 20 W and 60 W power supply. The mobile ATM 100 may include an exhaust fan 370 in the interior to provide ventilation of the interior. The exhaust fan 370 may exhaust through a vent/access 140. For example, the exhaust fan 370 may be a 7" exhaust fan.

The outlets 345 may support a number of different types of connections. Each outlet 345 may be a different type of port to support charging of a connected device. For example, standard electrical outlets, USB ports (of different types), firewire ports, Thunderbolt ports, etc., may be provided to allow for the connection and charging of a variety of portable electronic devices. For example, the outlets 345 may be configured to provide a low level of power commensurate with charging portable electronic devices. As depicted in FIG. 3 there may be four outlets 345, but this is meant to be exemplary as more or less outlets may be provided. The shelves 350 may provide a surface on which to place the connected device while charging.

The mobile ATM 100 may include a breaker box 405. The breaker box 405 may contain one or more circuit breakers controlling the electrical distribution of power to the various components of the mobile ATM 100.

An ATM unit 410 may be included. The ATM unit 410 may contain the hardware and software that provides the ATM functionality to the user. The ATM unit 410's front portion or face is depicted and described with respect to FIG. 7. The ATM unit 410 may be electrically powered. The ATM unit 410 may have a dedicated outlet 380 to supply power to it.

The mobile ATM 100 may include a hand winch 415. The hand winch 415 may allow for attachment of a cable to lower the platform 105 during installation the mobile ATM 100. While the hand winch 415 is depicted only on a single side of the mobile ATM 100, a second hand winch 415 may be located on the opposite side. The hand winch 415 may be removable. For example, following installation, the hand winch 415 may be removed and stored.

The mobile ATM 100 may include an external plug 420. The external plug 420 may include a male and/or female plug for electrical connection to external power sources. The external plug 420 may therefore provide a connection for the mobile ATM 100 to receive power from an external source. This external power can then be used in lieu of the mobile ATM's own power source(s). In some embodiments, the mobile ATM 100 can provide external power through the external plug 420 using its own power source(s). This may be in addition to the charging compartment 340's outlets 345. The external plug 420 may be configured and rated to provide a greater amount of power (i.e., more watts at a higher amp rating/voltage) than the outlets 345. The external plug 420 may include more than one plug to account for different connections. For example, the plug 420 may include a female side and a male side.

In some embodiments, the plug 420 may be compatible with or may employ more than one electrical connector type in order to accommodate different types of electrical connections. For example, different AC power plugs may be provided by the mobile ATM 100 for connection compliance to both the North American standard outlets (i.e., 120 volts), and the European standard outlets (i.e., 220-240 volts). In other embodiments, the mobile ATM 100 may have a connection kit including interchangeable electrical connectors, such as various power plugs, to allow the use of the multiple types of connections. These connectors may be fit into the plug 420. It should be appreciated that any combination of connectors and connector types may be used.

Internally also, storage for railing sections for the platform 105 may be provided at 425.

The mobile ATM 100 may be constructed with rigid, secure materials. The use of such materials may prevent theft and provide protection from the elements. Furthermore, the mobile ATM 100, or particular components thereof, may be constructed using various weather resistant materials (i.e., waterproof). These materials may include conventional materials employed in the manufacture of indoor/outdoor construction, such as rubber, steel, aluminum, and the like. These materials may also be able to withstand exposure to extreme weather conditions, such as heavy rain, that are associated with a disaster location. For example, aluminum sheets may be used to construct the ramp sections 115 of the mobile ATM.

The frame 450 of the mobile ATM 100 is depicted in FIG. 4B. The frame 450 may have an internal volume into which the various components of the mobile ATM 100, such as described herein, may be placed and secured. The various components may be secured to the frame 450 using various methods such as bolts, screws, hinges, snap fits, press fits, other securement methods, as well as combinations of such securement methods. The framing of the mobile ATM 100, such as post 430, may be steel. For example, a 2.5"×2.5"×3/16" steel tubing may be used for the corner posts 430. The framing may be a set of joined posts or tubes creating a rigid structure. A set of smaller posts 465 may be a part of the frame 450. For example, the smaller posts 465 may be 1.5"×1.5" 16-gauge steel tubing. It should be appreciated that other materials besides steel may be used for framing of the mobile ATM 100. A combination of materials may be used. For example, steel and aluminum may be used. In various embodiments, high strength plastic or composites may be used.

The charging compartment 340 may have a frame 460 defining its volume. The frame 460 may be made of 1"×1" 16-gauge steel tubing.

It should be appreciated that while only a single frame, post, or tube is labeled in FIG. 4B, that there may be more than one of each element, as can be clearly seen in FIG. 4B.

Figure 5:
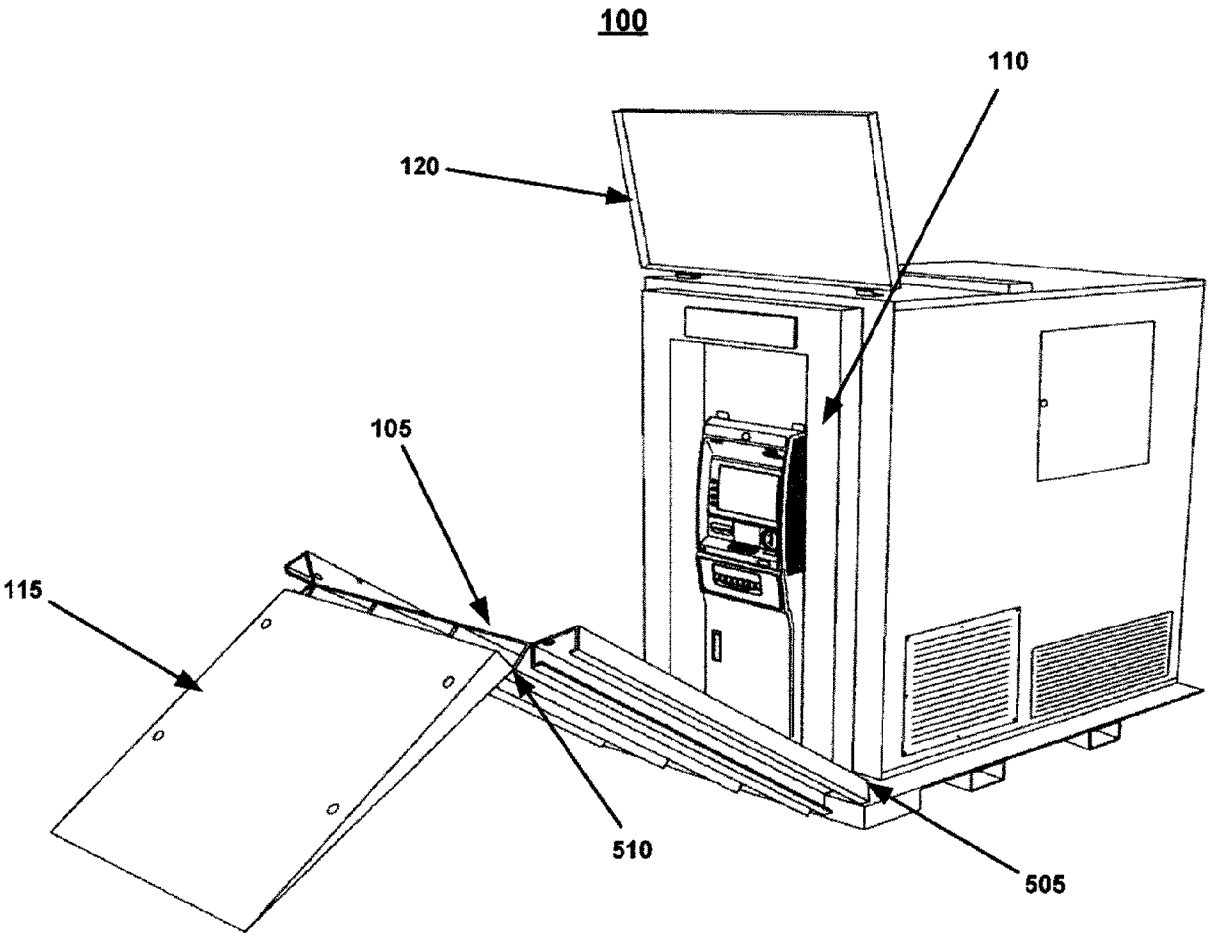
FIG. 5 depicts a perspective view of the mobile ATM device during deployment in accordance with an exemplary embodiment.

FIG. 5 depicts a perspective view of the mobile ATM device during deployment in accordance with an exemplary embodiment. This depiction depicts a state subsequent to the self-contained configuration for increased portability, as shown in FIG. 1, for example. The deployment may be fully automatic, partially automatic, or manual for the mobile ATM 100.

The mobile ATM 100 deployment may incorporate movement of various gears or hinges, in order to reveal the mobile ATM components (i.e., contained during transportation). The platform 105 and the ramp 115 are depicted in a state of deployment to an operational position being moved away from the front portion 110. The platform 105 is hingedly connected to a lower portion 505 the front portion 110 of the mobile ATM 100. The hinged connection may be to the frame of the mobile ATM 100. The ramp may in turn be hingedly coupled to an end of the platform 105 at 510. The roof 120 is also depicted being moved into its operational position. As described above with respect to FIG. 4, the hand winch 415 may be used to lower the platform and the ramp.

Figure 6:
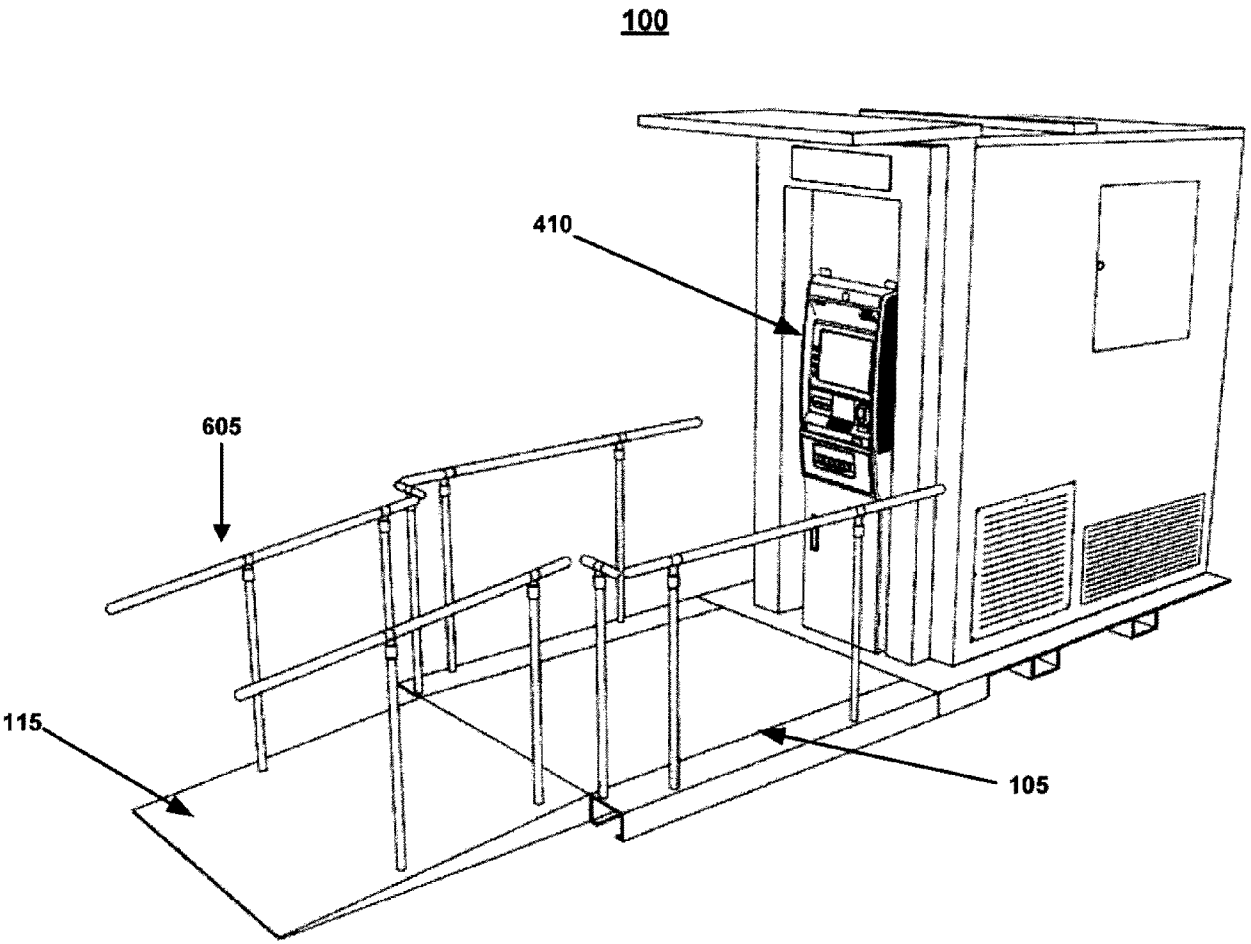
FIG. 6 depicts a side view of the deployed mobile ATM device in accordance with an exemplary embodiment.

FIG. 6 depicts a side view of the deployed mobile ATM device in accordance with an exemplary embodiment. Accordingly, FIG. 6 depicts the operational configuration that may result from full deployment of the mobile ATM 100 at an installation site. In the operational configuration, railings 605 may be installed (after removal from the interior of the mobile ATM 100 as described above with respect to FIG. 4). The ATM unit 410 may be visible to a customer. In FIGS. 3B and 4A, the roof 120 is depicted in an extended condition also.

The mobile ATM 100 may be compliant with the Americans with Disabilities Act ("ADA"). As depicted in FIG. 6, the platform 605 and the ramp 115 may make the mobile ATM 100 wheelchair accessible, for example. Other ADA compliant features may be included to further support accessibility to the mobile ATM for sight and hearing impaired persons. In some embodiments, ADA compliant features may include a braille keypad used for navigation, and voice commands to relay information intended for a display screen. According to some embodiments, the device may support height detection, display screens, and height adjustment functions. The display screen may be tiltable or otherwise adjustable in different dimensions to support lower viewing angles, thereby making the mobile ATM 100 more visible, for example.

Figure 7:
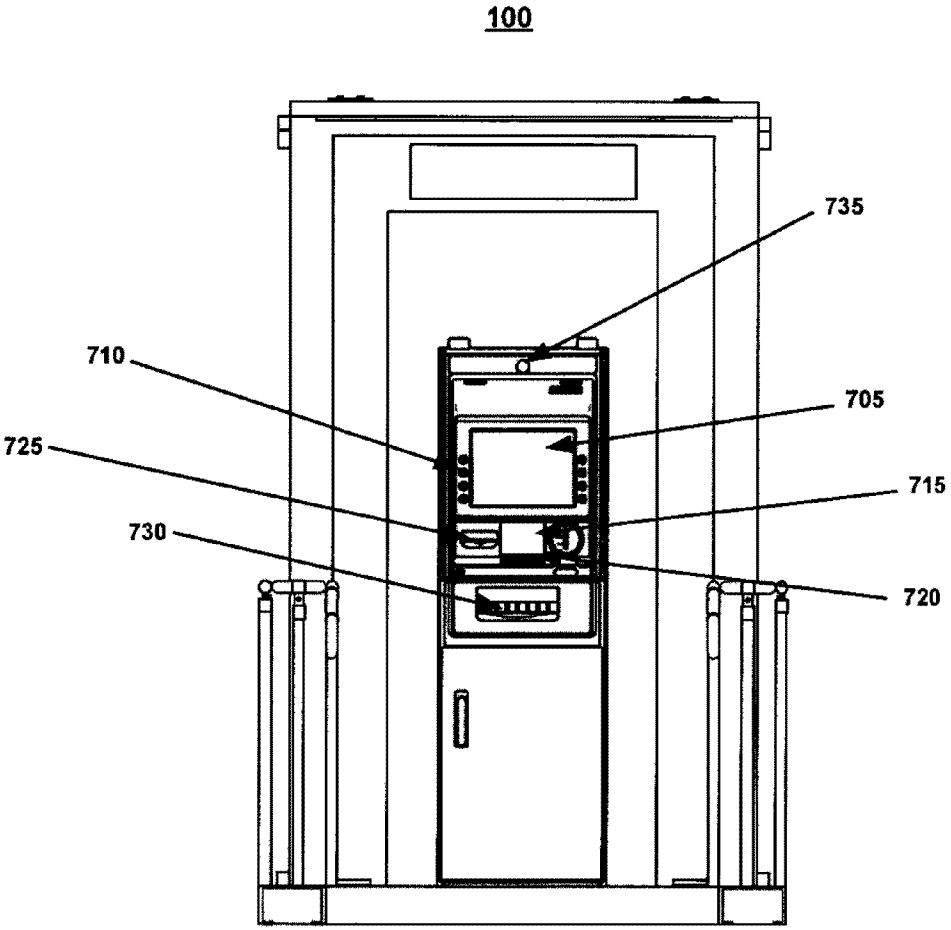
FIG. 7 depicts a front view of the deployed mobile ATM device in accordance with an exemplary embodiment.

FIG. 7 depicts a front view of the deployed mobile ATM according to an exemplary embodiment of the invention. The mobile ATM 100, when deployed, may provide various functionality and features associated with a financial services device to enable a user to conduct one or more financial transactions. The ATM unit 410 may include various input/output devices which may include a display 705. The display 705 may be monochrome or color. For example, the display 705 may be a plasma, liquid crystal, or cathode ray tube type display. The display 705 may be touch screen type display. The display 705 may include a series of buttons along its periphery to allow for selection of on-screen menu choices. The ATM unit 410 may have more than one display. The multiple displays may be different types of displays. For example, the mobile ATM 100 may have two displays. The second display 715 (optional) may be located below the display 705. The second display 715 may be a touch screen type display.

The display 705 may be used for display of information for the customer. The active display portion may be a smaller sub-set of the total screen area. This sub-set display may be adjustable in height as described herein. In some embodiments, the display screen 705 may be tiltable or otherwise movable to provide different viewing angles. These adjustments may be manually performed by the customer or may be electronically controlled from a set of menu options on the display screen. In this manner, the screen position may be adjusted to ensure the optimal viewing angle for the customer.

The ATM unit 410 may have a keypad and/or keyboard 720 for an input device. For example, the keypad and/or keyboard 720 may include a keyboard, either full-sized QWERTY or condensed and/or a numeric pad and/or an alpha-numeric pad. Additionally, a trackball and/or a touch pad may be provided. As described above, the display 705 and/or 720 may serve as input points through using or incorporating a touch screen interface. The ATM unit 410 may include other ATM components such as a printer 725 and a device for accepting deposits and/or dispensing currency 730. The ATM unit 410 may include one or more cameras, optical sensors, or other sensing devices 735. The sensors may be computer controlled and may capture digital images.

The ATM unit 410 may support various authentication or log-on systems and interaction. For example, these methods and systems may include entering a password or PIN (Personal Identification Number) or using a card to log-on, either via swiping the card through a reader, such as a magnetic stripe reader or a smart chip reader, or through a radio frequency system (which may require that the card be placed in proximity to an appropriate reader (i.e., a contactless system), including RFID (Radio Frequency Identification) and/or NFC (Near Field Communications). The reader may be a part of the keypad/board 720. Further, the use of the card is exemplary only and the card may include fobs, stickers, and other devices. Biometrics may be used, such as fingerprints, facial recognition, speech recognition, or retinal scan. A biometric reader may be incorporated into the ATM unit 410 in an appropriate location. A combination of these systems may be used. The mobile ATM 700 may have other components. These components may include various data collection and support systems used by the financial institution to carry out a variety of functions.

In an embodiment, the ATM unit 410 may include a wireless transceiver 435 that may be utilized for providing short-range wireless communications, long-range wireless communications, or any combination thereof. The wireless transceiver 435 may be implemented using any suitable component or device that may wirelessly transmit and/or receive audio and/or data signals, including analog and digital signals. The wireless transceiver 435 may communicatively couple to a network. The network may be a computer based network, with one or more servers and/or computer processors. For example, the network may be the Internet or a network connected to the Internet. The network may be a satellite or cellular-based network. Information and data may be exchanged through the network between the various devices. It should be appreciated that the network may be a combination of local area networks, wide area networks, and external networks, which may be connected to the Internet.

The wireless transceiver 435 may increase portability of the mobile ATM 100 by providing mobile communication capabilities. Wireless transceiver 435 configurations may support various wireless signals that may include, but not be limited to, Bluetooth, Wireless Application Protocol (WAP), Multimedia Messaging Service (MMS), Enhanced Messaging Service (EMS), Short Message Service (SMS), Global System for Mobile Communications (GSM) based systems, Code Division Multiple Access (CDMA) based systems, Transmission Control Protocol/Internet (TCP/IP) Protocols, or other protocols and/or systems suitable for transmitting and receiving data. For example, the wireless protocols can include IEEE 802.11a, 802.11b, 802.11g, and 802.11n. The wireless transceiver 435 may be used for conducting wireless communications between multiple distributed mobile ATMs over a wireless network.

Additionally, the mobile ATM may include various components, or devices, that support Global Positioning System (GPS) capabilities. For example, the wireless transceiver may include GPS capabilities.

In some embodiments, the mobile ATM may employ the wireless transceiver 435 to communicate with portable electronic devices or mobile devices. The portable electronic device may establish communications with a mobile ATM. Upon successful initiation of communications between the portable electronic device and mobile ATM, data may be exchanged between the device and the mobile ATM. Data may be transmitted from the portable electronic device to the mobile ATM. Data may be transmitted from the mobile ATM to the portable electronic device. For example, the mobile ATM may be used to perform several mobile banking features such as wireless financial transactions, remote banking sessions, and the like. The portable electronic device may be more than one portable electronic device. The portable electronic device may be associated with a customer. The mobile ATM may be able to support conducting simultaneous transactions with multiple portable electronic devices.

The portable electronic or mobile devices, by way of non-limiting examples, may include portable computing and communications devices such as mobile phones (e.g., cell or cellular phones), smart phones (e.g., iPhones, Android-based phones, or Blackberry devices), personal digital assistants (PDAs) (e.g., Palm devices), laptops, netbooks, tablets, or other portable computing devices.

In an embodiment, the mobile ATM 100 may include one or more sensors 440 to detect movement of the unit. The sensor 440 may include a transmitter to alert the financial institution if the mobile ATM is being moved. The transmitter may be coupled to the wireless transceiver 435 in the ATM unit 410. For example, the sensor may be used to indicate unauthorized movement of the mobile ATM. The sensors 440 may not be visible to the customer and may be internal to the mobile ATM unit 100. The sensors 440 may be of different types and may include motion-sensing devices such as accelerometers. Other types of sensors may be used. According to some embodiments, a combination of sensor types may be used.

Figure 8:
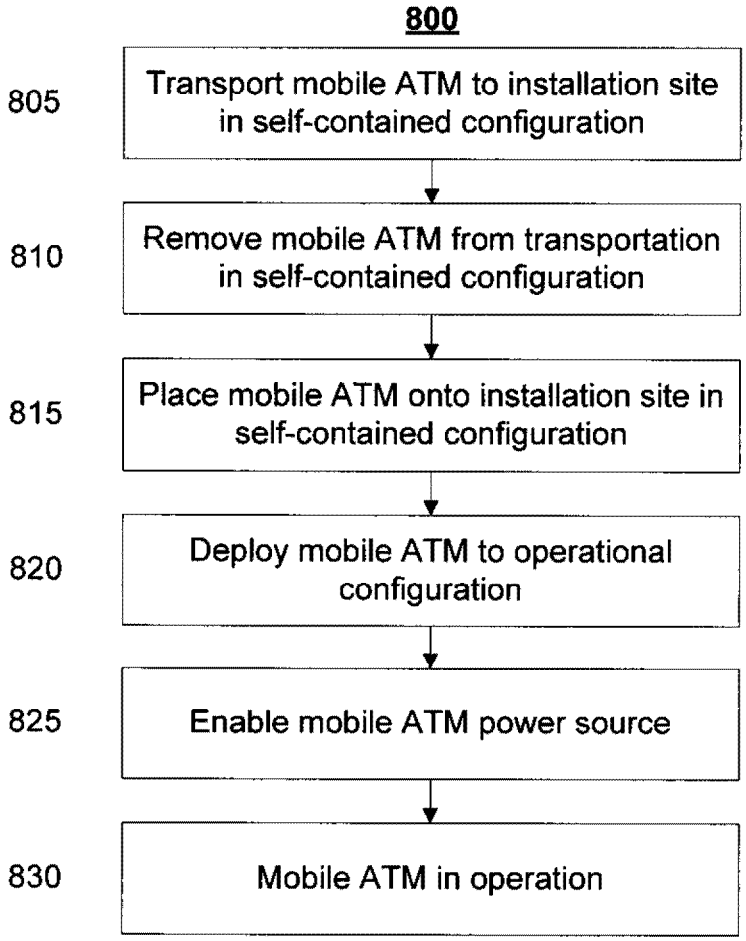
FIG. 8 depicts a flow chart of a method of transporting and interfacing with a mobile ATM in accordance with an exemplary embodiment.

FIG. 8 depicts a flow chart of a method employed for deploying and interfacing with a mobile ATM according to exemplary embodiments of the invention. Exemplary method 800 is provided by way of example, as there are a variety of ways to carry out the methods disclosed herein. The method 800 as shown in FIG. 8 may be executed or otherwise performed by one or a combination of various systems.

The method 800 may be computer implemented as a system. The system of the invention or portions of the system of the invention may be in the form of a "processing machine," for example. As used herein, the term "processing machine" is to be understood to include at least one processor that uses at least one memory. The at least one memory stores a set of instructions. The instructions may be either permanently or temporarily stored in the memory or memories of the processing machine. The processor executes the instructions that are stored in the memory or memories in order to process data. The set of instructions may include various instructions that perform a particular task or tasks, such as those tasks described above in the flowcharts. Such a set of instructions for performing a particular task may be characterized as a program, software program, or simply software.

At block 805, the mobile ATM may be transported to an installation site. Prior to transport, the mobile ATM may be secured into a configuration for transport, such as depicted in FIG. 1. A forklift can be used to move the mobile ATM from a storage area onto a flatbed truck for transport. The installation site may be a natural location (i.e., outdoors) or a man-made location (i.e., building).

At block 810, at the installation site, the mobile ATM may be removed from the ground transportation. For example, a forklift may be used to remove the mobile ATM using the slots as described above. After the truck has arrived at the installation site, a forklift can be used to move the mobile ATM off the truck and onto the installation site. The installation site may be selected as having an appropriate size and geography to accommodate the mobile ATM placement. In some embodiments, the installation site may be required to have a sufficiently hard and flat surface to provide a stable platform for the mobile ATM.

At block 815, the mobile ATM may be placed onto the installation site. For example, the forklift may lower the mobile ATM onto the installation site and then remove its forks from the slots.

In block 820, the mobile ATM may be deployed for operational configuration. Prior to block 820, the mobile ATM may remain in the self-contained configuration. The mobile ATM deployment may include performing a series of mechanical maneuvers. These deployment maneuvers may be fully automatic, partially automatic, or manual for the mobile ATM. The deployment may incorporate movement of various gears and hinges in order to reveal the particularly retracted and securely situated mobile ATM components (i.e., contained during transportation). In an embodiment, at least the roof, platform, and the ramp are unfolded to change the configuration from the self-contained configuration to the operational configuration. The operational configuration may include placement of the ramp and platform on the ground at the base of the mobile ATM. Additionally, the roof of the mobile ATM may be unfolded to provide a protective covering, for example an awning, over the customer interface components of the ATM (i.e., screen). In the operational configuration, components that provide the features and functionality of conventional ATM devices, such as a display, printer, and a device for accepting/dispensing currency, are made readily accessible for a customer. For example, the ramp and platform, which are configured to protectively cover the front of the mobile ATM during transportation, are unfolded to make these conventional ATM components visible for a customer.

In block 825, the power source of the mobile ATM may be enabled. The mobile ATM power source may be either an internal power source or an external power source, as described above. The power source of the mobile ATM may be enabled through conventional power control mechanisms, such as power button, power switch, and on/off controls, for example. In an embodiment, the power source may be enabled automatically without user interaction. For example, the power source may be automatically "turned on" when an electrical plug is coupled to an external power source. Furthermore, the power source may be enabled using a device remotely located from the mobile ATM and the installation site. Accordingly, in an embodiment, the mobile ATM may receive a wireless signal from a remote controlling device, in order to activate the internal power source. Upon enabling the power source, the mobile ATM may become operational and perform various mechanical and processing functions. In block 830, a customer may interface with the mobile ATM in full operational configuration. In an embodiment, within an hour of arriving at the installation site, the mobile ATM is installed, fully functional, and ready for customer usage. For example, at the installation site, a mobile ATM in operation configuration may provide an interface which enables a user to conduct various financial transactions.

While the embodiments have been particularly shown and described within the framework of financial services devices, it will be appreciated that variations and modifications may be effected by a person of ordinary skill in the art without departing from the scope of the invention. Furthermore, one of ordinary skill in the art will recognize that such processes and systems do not need to be restricted to the specific embodiments described herein. Other embodiments, combinations of the present embodiments, and uses and advantages of the present invention will be apparent to those skilled in the art from consideration of the specification and practice of the invention disclosed herein. The specification and examples should be considered exemplary.

Accordingly, while the present invention has been described here in detail in relation to its exemplary embodiments, it is to be understood that this disclosure is only illustrative and exemplary of the present invention and is made to provide an enabling disclosure of the invention. Accordingly, the foregoing disclosure is not intended to be construed or to limit the present invention or otherwise to exclude any other such embodiments, adaptations, variations, modifications, and equivalent arrangements.

What is claimed is:

1. An apparatus, comprising:

a financial services device having an internal volume define by a rigid frame, comprising:

a financial services unit, contained in the internal volume, having a display and a computer process, configured to provide financial transaction capability;

a stand-alone power source, contained in the internal volume, that is configured to generate power to operate the financial services device;

an external platform hindgedly coupled to a bottom section of the rigid frame and configured to retract in a manner to rest against a front section of the financial services device;

an external ramp hingedly coupled to the platform and configured to retract in a manner such that the ramp rests against the platform; and a roof hindgedly coupled to a top section of the financial services device.

2. The financial services device of claim 1, further comprising: one or more wireless transceivers, wherein the one or more wireless transceivers are configured to establish wireless communication with one or more external devices.

3. The financial services device of claim 2, wherein the one or more external devices comprises at least one of a portable electronic device, a cell phone, an email device, a portable communication device, or a financial services device.

4. The financial services device of claim 1, wherein the in stand-alone power source comprises at least one of: a battery, a gas-powered generator, a solar cell, or a combination thereof.

5. The financial services device of claim 1, further comprising: one or more slots in the rigid frame, wherein the one or more slots are configured to receive one or more transportation mechanisms employed for transporting the financial services device.

6. The financial services device of claim 5, wherein one or more the transportation mechanisms comprises a forklift.

7. The financial services device of claim 1, wherein the ramp is further configured for wheelchair accessibility.

8. The financial services device of claim 1, further comprising: railings installed along the ramp and platform.

9. The financial services device of claim 1, further comprising: one or more sensors configured to detect movement of the financial services device.

10. The financial services device of claim 1, further comprising: a compartment, accessible through a panel on a side of the financial services device, contained one or more ports configured to accept an electrical connector for charging an electronic device.

11. The financial services device of claim 10, wherein the electronic devices comprise at least one of: a rechargeable battery, a cell phone, a portable computing device, portable electronic device, or an email device.

12. The financial services device of claim 1, further comprising: one or more electrical connectors are configured to receive power from an external source.

13. A method, comprising:

transporting a financial services device to an installation site in a first configuration using a transportation mechanism, wherein the first configuration is a configuration for transportation of the financial services device, and further wherein the financial services device is configured to:

provide a financial transaction capability by employing a financial services unit having a display and a computer processor, wherein the financial services unit is contained in an internal volume of the financial services device; and generate power to operate the financial services device by employing a stand-alone power source, the stand-alone power source being contained in the internal volume of the financial services device;

removing the financial services device from the transportation mechanism in the first configuration;

placing the financial services device onto a surface located at the installation site in the first configuration;

deploying the financial services device to second configuration by extending retracted components of the financial services device, the retracted components comprising:

an external platform that is configured to rest against a front section of the financial services device when retracted, the external platform being hindgedly coupled to a bottom section of the rigid frame of the financial services device;

an external ramp that is configured to rests against a platform of the financial services device when retracted, the external ramp being hingedly coupled to the external platform; and a roof that is configured to rest against a top section of the financial services device when retracted, the roof being hindgedly coupled to the top section of the financial services device; and enabling the stand-alone power source to operate the financial services device such that the financial services device is fully operational.

14. The method of claim 13, further comprising: receiving, by one or more slots, one or more transportation mechanisms employed for transporting the financial services device.

15. The method of claim 13, wherein the stand-alone power source comprises at least one of: a battery, a gas-powered generator, a solar cell, or a combination thereof.

* * * * *